United States Patent [19]

White, Jr.

[11] Patent Number: 4,606,071

[45] Date of Patent: Aug. 12, 1986

[54] LOUDSPEAKER SYSTEM UTILIZING AN EQUALIZER CIRCUIT

[76] Inventor: Lahroy A. White, Jr., 4008 Pinehurst, Amarillo, Tex. 79109

[21] Appl. No.: 639,800

[22] Filed: Aug. 13, 1984

[51] Int. Cl.[4] ..... H04R 3/14

[52] U.S. Cl. ..... 381/99; 381/103

[58] Field of Search ..... 381/99, 103; 333/28 T, 333/176, 132; 369/175

[56] References Cited

U.S. PATENT DOCUMENTS

| | | | |
|---|---|---|---|
| 3,457,370 | 7/1969 | Boner | 381/99 |
| 3,931,469 | 1/1976 | Elliott | 381/99 |
| 4,475,233 | 10/1984 | Watkins | 381/99 |
| 4,483,015 | 11/1984 | Strohbeen | 333/28 T |

FOREIGN PATENT DOCUMENTS

| | | | |
|---|---|---|---|
| 2938938 | 4/1980 | Fed. Rep. of Germany | 381/99 |
| 2910318 | 9/1980 | Fed. Rep. of Germany | 381/103 |
| 55-45210 | 3/1980 | Japan | 381/99 |
| 2145904 | 4/1985 | United Kingdom | 381/99 |

OTHER PUBLICATIONS

Smith, J. B., et al., "Improvements in Monitor Loudspeaker Systems," *Journal of Audio Eng. Society*, vol. 31, No. 6, Jun. 1983, pp. 408–422.

*Primary Examiner*—Gene Z. Rubinson
*Assistant Examiner*—L. C. Schroeder
*Attorney, Agent, or Firm*—James P. Hamley

[57] ABSTRACT

A loudspeaker system includes a low-frequency driver and a high-frequency driver which are connected to a crossover network. The crossover network includes an inductor in series with the low-frequency driver for attenuating high-frequency signals at the crossover frequency and a capacitor in series with the high-frequency driver for attenuating low-frequency signals at the crossover frequency. An equalizer circuit connects between the high- and low-frequency drivers and operates to dampen resonant ringing which is otherwise produced. The equalizer circuit preferably comprises a series LRC circuit having a resonant frequency and a Q factor equal to the resonant frequency and Q factor of the circuit formed by the crossover network and drivers. The equalizer circuit is particularly suited for application in a disclosed loudspeaker system which utilizes a high inductance crossover inductor to enhance system bass response without sacrificing clarity.

7 Claims, 1 Drawing Figure

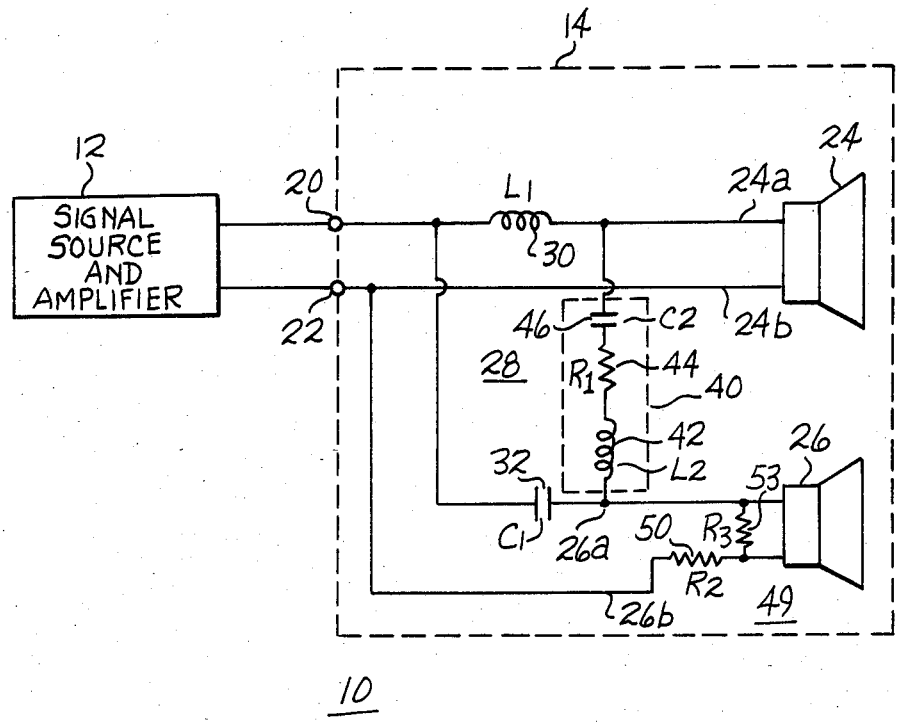
14
12
SIGNAL SOURCE AND AMPLIFIER
20
22
L1
30
24
24a
24b
46
C2
28
R1
44
40
42
L2
26
32
53
C1
26a
50
R3
R2
26b
49
10

LOUDSPEAKER SYSTEM UTILIZING AN EQUALIZER CIRCUIT

BACKGROUND OF THE INVENTION

This invention is described in Disclosure Document No. 126,933 filed Apr. 27, 1984, in the U.S. Patent and Trademark Office.

The present invention pertains to the loudspeaker system art and, more particularly, to loudspeaker systems including frequency shaping equalizer circuits.

Conventional loudspeaker systems employ an enclosure that houses one or more speakers, or drivers. The drivers are typically mounted in openings provided through the front baffle of the enclosure, such that front wave radiation from the speaker radiates into the listening area, whereas backwave energy is radiated within the enclosure.

A problem encountered by designers of loudspeaker systems has been that the response of a typical driver is linear only over a limited bandwidth. Thus, to provide a relatively flat frequency response over the entire audio bandwidth (i.e., 20–20, 000 Hz) multiple drivers have been employed in high quality loudspeaker systems, with each of the multiple drivers specifically designed to cover a selected portion of the audio bandwidth. In a two-way system, for example, a low-frequency driver, or woofer, is employed for low frequencies and a high-frequency driver, or tweeter, is used for high frequencies.

To assure a smooth response over the audio bandwidth, loudspeaker system designers have utilized crossover networks in an attempt to produce a "seamless" overall system response for signals that occur within the crossover points of multiple drivers. The function of the crossover network in a two-way system is to divide the input signal from the amplifier into low-frequency signals which are routed to the woofer and high-frequency signals which are routed to the tweeter. The high-frequency response of the woofer is rolled off in a controlled manner, with the tweeter's low-frequency response rolled off in a complementary manner such that as constant amplitude signals of varying frequency are applied to the overall system, a linear frequency response is obtained even at the crossover frequency.

In most conventional loudspeaker systems, bass response is augmented by resonance of the low frequency driver and the enclosure. Upon the loudspeaker being driven by a signal at, or near, this resonant frequency, a resonant mode is excited and the loudspeaker system "rings," producing a corresponding output. Whereas some listeners are initially deceived by this ringing believing it to be a bass enhancement, in fact such ringing constitutes a distortion which obscures the clarity of the sound being reproduced, ultimately leading to listener fatigue and dissatisfaction with the loudspeaker system.

SUMMARY OF THE INVENTION

It is an object of this invention, therefore, to provide a loudspeaker system that employs an equalizer circuit for substantially reducing, or eliminating the resonant ringing produced by the crossover components in a multiple driver loudspeaker system.

It is a further object of this invention to provide a loudspeaker system which provides an enhanced bass response without the use of loudspeaker system resonant effects.

Briefly, according to the invention, a loudspeaker system comprises first and second input terminals which are adapted to receive an electrical signal to be transduced by the loudspeaker system. Both low- and high-frequency drivers are provided, each having first and second input contacts. The crossover network for the loudspeaker system includes a first inductor coupled between the first input terminal and the low-frequency driver first contact, with the first driver having a predetermined inductance $L_1$ selected to attenuate signals above a predetermined first frequency. The crossover network also includes a first capacitor coupled between the first input terminal and the high-frequency driver first contact. The first capacitor has a predetermined capacitance $C_1$ selected to attenuate signals below a selected crossover frequency. An equalizer circuit couples between the low-frequency driver and the high-frequency driver, with the equalizer circuit exhibiting a predetermined impedance characteristic selected to compensate for resonant effects in the loudspeaker system.

Preferably, the equalizer circuit comprises a series connection of a second inductor, having an inductance $L_2$, a second capacitor, having a capacitance $C_2$, and a resistor, having a resistance $R_1$. The series connected equalizer components are coupled between the low-frequency driver first contact and the high-frequency driver first contact.

The values of the equalizer components are, preferably, selected such that:

$L_1 \simeq L_2$ $C_1 \simeq C_2$, and $R_1$ is selected to be equal to the sum of the DC resistances of the low-frequency driver and the high-frequency driver.

The high-frequency driver may include an L-pad comprised of a series resistor, having a resistance $R_2$, and a shunt resistor, having a resistance $R_3$, coupled between the high-frequency driver and the high-frequency driver first and second contacts for predeterminedly attenuating the signal applied to the high-frequency driver such that the sound levels produced therefrom match the sound levels produced by the low-frequency driver.

Loudspeaker system bass enhancement is preferably realized by providing said first inductor having an inductance $L_1$ selected to attenuate signals above said first frequency, which first frequency is significantly lower than said crossover frequency. The first capacitor preferably has a capacitance selected to exhibit the same reactance as said first inductor at said crossover frequency.

BRIEF DESCRIPTION OF THE DRAWINGS

The sole FIGURE for the invention is a schematic diagram illustrating the preferred embodiment of a two-way loudspeaker system utilizing the inventive equalizer circuit.

DETAILED DESCRIPTION

Referring to the single FIGURE for the invention, illustrated are the principal components of a sound reproduction system, indicated generally at 10. A signal source 12 produces the electrical signals to the transduced. Examples of signal source 12 include a microphone pick-up, a phonograph pick-up, a tape head pick-up, or any of several other known signal sources. The signal produced by signal source 12 is amplified by an included amplifier which produces sufficient power to drive the loudspeaker system 14 as shown in dotted lines.

The output signal from the signal source and amplifier 12 is applied to the first and second input terminals, 20, 22, respectively, of the loudspeaker system 14. Loudspeaker system 14 is a two-way system, including a low-frequency driver, or a woofer 24, and a high-frequency driver, or tweeter 26. Low-frequency driver 24 is provided with first and second input contacts **24*a*, 24*b*, respectively, with high-frequency driver 26 being provided with first and second input contacts 26*a*, 26*b*, respectively. The drivers 24, 26 are commonly mounted within an enclosure (not shown) such that the front wave radiation from the drivers 24, 26** projects into the desired listening area, with backwave radiation being radiated within the enclosure.

A crossover circuit, indicated generally by reference numeral 28, frequency shapes and couples the signals from the loudspeaker input terminals 20, 22 to the low-frequency driver 24 and the high-frequency driver 26.

The crossover network 28 includes an inductor 30 which connects between the loudspeaker system first terminal 20 and the first contact **24*a* of the low-frequency driver 24. The inductance $L_1$ of the inductor 30 is selected to produce a rolloff in the high-frequency response of the low-frequency driver 24 at a first frequency which, as will be described in detail hereinbelow, is significantly lower than the crossover frequency of crossover network 28**.

A capacitor 32 connects between the loudspeaker system first terminal 20 and the first contact **26*a* of the high-frequency driver 26. The capacitance $C_1$ of capacitor 32 is selected to exhibit the same reactance as inductor 30** at the crossover frequency.

The crossover frequency for a particular system is, in accordance with well-known loudspeaker design principles, selected as a function of the particular drivers employed and the specific enclosure design and, as such, will not be described in greater detail herein.

The inductor 30 and capacitor 32 are seen to form a resonant circuit having a resonant frequency at the crossover frequency. Thus, for signals produced by the signal source and amplifier 12 which are at or near the designed crossover frequency, the natural resonance of the crossover circuit 28 will be excited, producing ringing and leading to an overemphasis of crossover and near crossover signals. This emphasis creates an undesirable nonlinearity which is apparent to listeners.

In accordance with the present invention, this undesirable ringing can be substantially reduced, or eliminated, by use of an equalizer circuit 40. Equalizer circuit 40 is, preferably, a series resonant circuit comprised of the series connection of an inductor 42, having an inductance $L_2$, a resistor 44, having a resistance $R_1$, and a capacitor 46, having a capacitance $C_2$. The equalizer circuit 40 is connected between the first contact **24*a* of the low-frequency driver 24 and the first contact 26*a* of the high-frequency driver 26**.

The equalizer circuit 40 is designed to resonate at the crossover frequency of the crossover network 28, exhibiting the same Q factor as the Q factor of the circuit formed by the crossover network 28 and the two drivers 24, 26.

Thus, preferably, the values of the components in the equalizer circuit 40 are selected such that:

$L_2 \simeq L_1$, $C_2 \simeq C_1$, and $R_1$ equals the sum of the DC resistances of the drivers 24, 26.

In the two-way loudspeaker system illustrated in the FIGURE, a conventional L-pad 49 is used to attenuate the signals applied to the high-frequency driver 26 such that its output matches the output of the low-frequency driver 24. The L-pad 49 connects between the high-frequency driver 26 first and second input contacts **26*a*, 26*b*, respectively, and the high-frequency driver 26. The L-pad 49 is comprised of a series resistor 50, having a resistance $R_2$, and a shunt resistor 52, having a resistance $R_3$. The values of the resistors 50, 52** are selected in accordance with well-known techniques in this art.

Alternatively, the L-pad 49 may be formed with series resistor 50 and shunt resistor 52 comprised of potentiometers having values selected to provide a constant impedance load to the signal source and amplifier 12, while providing continuous control of the volume of high frequency driver 26.

For applications wherein the L-pad resistors 50, 52 are employed, the value of the equalizer resistor 44 should be appropriately adjusted.

In operation, signals from the signal source and amplifier 12 which are below the crossover frequency of crossover network 28 are routed to the low-frequency driver 24, with those signals having a frequency above the crossover frequency of crossover network 28 being applied to the high-frequency driver 26, after appropriate attenuation by the L-pad resistors 50, 52. Signals at the input terminals 20, 22, which are at or near the crossover frequency of crossover network 28 and would otherwise produce resonant ringing due to the parallel resonant circuit formed by inductor 30 and capacitor 32, are damped by the series resonant circuit of the equalizer 40. This damping is made as precise as possible by designing the resonant frequency and the Q factor of the equalizer 40 equal to the resonant frequency and the Q factor of the circuit formed by the crossover circuit 28 and the drivers 24, 26 (including the L-pad resistors 50, 52). Thus, in operation, signals from the signal source and amplifier 12 are coupled through the crossover circuit 28 and equalizer circuit 40 to the drivers 24, 26 without emphasis due to crossover circuit ringing.

As a result, the response characteristics of the loudspeaker system 14, employing the equalizer circuit 40, are noticeably more linear than systems known to the prior art.

A particular feature of the present invention is that equilizer 40 permits the use of a crossover inductor 30 having an inductance $L_1$ substantially higher than the inductance of such inductors employed in conventional designs. By increasing the value of inductor 30, increased attenuation of higher frequency signals passed to low frequency driver 24 is realized, thereby increasing the bandwidth of signals produced by this driver. That is, the increased attenuation of higher frequency signals provided by increasing the inductance $L_1$ of inductor 30 compensates for the inherent low frequency roll off of driver 24, resulting in an extended bass response. This extended bass response is accomplished without resort to exciting a resonant mode of the loudspeaker system with the attendant distortion such an approach entails.

The value of inductor 30 is selected to roll off the response of low frequency driver 24 at a frequency which is significantly lower than the crossover frequency of crossover network 28. For the particular construction described below, inductor 30 was selected with an inductance $L_1$ which produced a roll off of driver 24 above approximately 100 Hz, whereas the crossover frequency, i.e., the frequency at which the reactance of inductor 30 equals the reactance of capacitor 32, was selected at approximately 500 Hz.

Were it not for the damping provided by equilizer 40, the use of an increased inductance inductor 30 would produce objectionable ringing in the response of the loudspeaker system.

In one particular construction of the invention, the drivers employed were a Dynaudio brand model 21W540 4 woofer and a Siare brand model TWZV tweeter and the enclosure was of the type described in U.S. Pat. No. 4,408,678, issued Oct. 11, 1983, to the same inventor, having inside dimensions:

Width=11".

Depth=9½".

Height=15", formed of ⅛" plastic suspended in a wooden frame with a solid wood front baffle board.

The values for the crossover and equalizer circuits were selected as follows:

$L_1=L_2=6.5$ millihenry $C_1=C_2=1.5$ microfarads, and $R_1=15$ ohms.

The values for the L-pad were selected as:

$R_2$ is a potentiometer which is variable between 0–∞ ohms, and $R_3$ is a potentiometer which tracks $R_2$ and varies between 7.2–0 ohms.

It will be noted that for most values of the high-frequency rolloff inductor 30, this inductance will be significantly greater than the inherent inductance of the drivers 24 or 26. As such, by making the equalizer inductor 42 equal to the crossover network inductor 30, precise damping of the inductive reactance in the network formed by the crossover and drivers is accomplished. However, for designs wherein the inherent inductance of the employed drivers is not small with respect to the selected value of the crossover inductor, the value of the equalizer inductor should be appropriately adjusted.

In summary, an improved loudspeaker system employing an equalizer circuit for damping the resonant ringing produced by a crossover network has been described. The equilizer circuit is particularly useful in damping ringing which is otherwise produced by a disclosed crossover network employing a large inductance inductor in series with the low frequency driver to enhance the bass response of the loudspeaker system without sacrificing system clarity.

Whereas a preferred embodiment of the invention has been described in detail, it should be apparent that many modifications and variations thereto are possible, all of which fall within the true spirit and scope of the invention.

The embodiments of the invention in which an exclusive property or privlilege is claimed are defined as follows:

1. A loudspeaker system comprising:

first and second input terminals adapted to receive an electrical signal to be transduced by said loudspeaker system;

a low-frequency driver having first and second input contacts;

a high-frequency driver having first and second input contacts;

a first inductor coupled between said first input terminal and said low-frequency driver first contact, said first inductor having a predetermined inductance $L_1$ selected to attenuate signals above a predetermined first frequency;

a first capacitor coupled between said first input terminal and said high-frequency driver first contact, said first capacitor having a predetermined capacitance $C_1$ selected to attenuate signals below a predetermined crossover frequency; and an equalizer circuit comprising a series connection of a second inductor, having an inductance $L_2$, a second capacitor, having a capacitance $C_2$, and a resistor, having a resistance $R_1$, said series connected equalizer components being coupled between said low-frequency driver first contact and said high frequency driver first contact, said equalizer circuit exhibiting a predetermined impedance characteristic selected to compensate for resonant effects in said loudspeaker system.

2. The loudspeaker system of claim 1 wherein:

$L_1 \simeq L_2$;

$C_1 \simeq C_2$; and wherein $R_1$ is selected to be equal to the sum of the DC resistances of said low-frequency driver and said high-frequency driver.

3. The loudspeaker system of claim 2 wherein said high-frequency driver includes an L-pad comprised of a series resistor, having a resistance $R_2$, and a shunt resistor, having a resistance $R_3$, coupled between said high-frequency driver and said high-frequency driver first and second contacts for predeterminedly attenuating the signal applied to said high-frequency driver such that the sound levels produced therefrom match the sound levels produced by said low-frequency driver.

4. The loudspeaker system of claim 1 wherein said equalizer circuit is a series resonant circuit having a Q factor approximately equal to the Q factor of the circuit formed by said first inductor, said first capacitor and said low-frequency and high-frequency drivers, whereby said equalizer circuit damps resonant ringing which would otherwise be produced.

5. The loudspeaker system of claim 4 wherein said high-frequency driver includes an L-pad comprised of a series resistor, having a resistance $R_2$, and a shunt resistor, having a resistance $R_3$, coupled between said high-frequency driver and said high-frequency driver first and second contacts for predeterminedly attenuating the signal applied to said high-frequency driver such that the sound levels produced therefrom match the sound levels produced by said low-frequency driver.

6. The loudspeaker system of any one of claims 1 and 2–5 wherein:

said first inductor has an inductance $L_1$ selected to attenuate signals above said first frequency, which first frequency is signficantly lower than said crossover frequency.

7. The loudspeaker system of claim 6 wherein:

said first capacitor has a capacitance selected to exhibit the same reactance as said first inductor at said crossover frequency.

* * * * *